US005876547A

United States Patent [19]

Kiesow et al.

[11] Patent Number: 5,876,547

[45] Date of Patent: Mar. 2, 1999

[54] MUG PRINTING CLAMPING DEVICE

[75] Inventors: Ronald H Kiesow, Spencerport; Raymond E Wess, Holley, both of N.Y.

[73] Assignee: Eastman Kodak Company, Rochester, N.Y.

[21] Appl. No.: 700,246

[22] Filed: Aug. 20, 1996

[51] Int. Cl.[6] ..... B30B 1/26; B65C 3/06

[52] U.S. Cl. ..... 156/215; 156/212; 156/240; 156/475; 156/540; 156/583.3

[58] Field of Search ..... 156/212, 475, 156/540, 583.1, 583.3, 240, 215; 101/35, 488; 100/33 PB, 306, 211, 212; 74/22 A, 53, 54, 55, 570

[56] References Cited

U.S. PATENT DOCUMENTS 3,309,985 3/1967 Nowak ..... 101/35
3,663,793 5/1972 Petro et al. ..... 101/35
4,874,454 10/1989 Talalay et al. ..... 156/359
5,019,193 5/1991 Aramini ..... 156/65
5,244,529 9/1993 Siegel ..... 156/475

*Primary Examiner*—Richard Crispino
*Attorney, Agent, or Firm*—Nelson Adrian Blish

[57] ABSTRACT

A mug printing clamping device (20) is shown for transferring images to curved substrates such as the surfaces of a mug (10). The device employs a flexible band (28) which forms a cylindrical cavity lined with a pad (30). A decal (14) containing the image to be transferred is inserted between the pad (30) and the mug (10) and pressure is applied to the flexible band (28) by rotating cam (38) counter clockwise, which moves slidable post (58) in the direction of adjustable post (36). A ratchet gear (40) and pawl (42) lock cam (38) into position enabling mug printing clamping device (20) to accommodate a wide variety of mug sizes. The mug (10) and decal (14) are then heated, causing the sublimation dyes on the decal (14) to transfer the image on the decal (14) to the surface of the mug (10).

11 Claims, 6 Drawing Sheets

MUG PRINTING CLAMPING DEVICE

BACKGROUND OF THE INVENTION

1. Field of the Invention

This invention relates in general to a method and apparatus for transferring images to cylindrical surfaces or cylindrical objects and more particularly to the sublimation transfer of images to a mug by means of the application of heat and a controlled amount of pressure.

2. Description of Related Art

One method of decorating cylindrical articles comprises the use of sublimation transfer techniques involving the printing of a design on a paper backing sheet by conventional printing techniques with sublimation inks, and transferring such designs under heat and pressure to a substrate. During the process, the dyes vaporize from the backing sheet and condense on the cooler substrate to form a brilliant image.

To properly affix the image, uniform pressure and temperature must be applied over the entire expanse of a decal containing the image and, in turn, over that cylindrical portion of the mug that is overlaid with the decal. Prior art processes press a rigid, bulky, heated, curved, metal casting to one side of the cup-shaped portion of the mug, or hinge together two such metal castings and press the latter toward opposite sides of the cup-shaped portion of the mug.

Although the use of curved castings is generally satisfactory for its intended purpose of applying an image on a curved surface, such curved castings have not proven altogether satisfactory. First, it is often desirable to apply large decals to the mug, i.e. those which extend around the cup-shaped portion over an arc length greater than 180°. The known castings can only effectively apply small decals to one or a plurality of areas on the cup-shaped portion of the mug. Typical prior art process do not permit mugs of different sizes to be accommodated in a single apparatus. An 8-oz. mug requires a different clamping device than a 12-oz. mug due to their different radii of curvature. As a result, the different clamping devices can only readily handle a single mug size. Different clamps of different sizes with adjustably would be required to handle different sized mugs.

In an effort to overcome the deficiencies of the process described, some prior art devices presently have used flexible straps to compensate for the different curvature and diameters of the cylindrical substrates that can be accepted. These attempts to solve these problems have not been entirely successful. U.S. Pat. No. 4,874,454 and U.S. Pat. No. 5,019,193 disclose devices for transferring sublimation decals to mugs using a flexible electrical heating pad. These devices are limited, however, in the amount of pressure that can be applied to the mug as a function of the diameter of the mug, with out making separate adjustments for various mug diameters.

SUMMARY OF THE INVENTION

It is an object of this invention to affix an image to a portion of the curved surface of a mug by uniformly applying pressure and heat over the entire expanse of a decal containing the image, with an amount of pressure that can be varied from one mug size to another, and set at consistent values.

A mug printing clamping device according to the present invention has a flexible band attached to a cam. A mug is at least partly inserted into a loop formed by the flexible band and a decal containing the image to be transferred to the mug is inserted between the mug and the flexible band. A ratchet locks the cam in position allowing the device to handle a wide variety of mug sizes. The flexible band, mug, and decal are heated to transfer the image from the decal to the mug. In one embodiment the cam is turned with a lever to apply consistent pressure over a wide range of mug diameters to the decal and the mug.

DETAILED DESCRIPTION OF THE INVENTION

Figure 1:
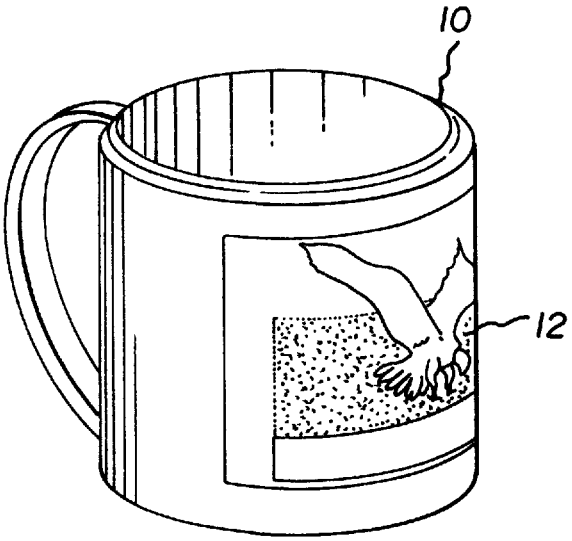
Fig. 1 PRIOR ART
FIG. 1 is an isometric view of a ceramic mug decorated by means of a sublimation decal design.

FIG. 1 shows an isometric view of a ceramic mug 10, decorated with a image 12 transferred by means of a sublimation decal. Due to their relatively impervious surface, glazed ceramic articles do not lend themselves to the acceptance of sublimation dyes of the type employed on the decals used to transfer images. The surface of the ceramic article is typically coated with a layer of epoxy polymer capable of accepting the sublimation dye. An epoxy coating from about 0.5 to 1 mil in thickness is often employed. The selected image is usually transferred on the front of the mug, opposite the handle, where it is readily visible.

Figure 2:
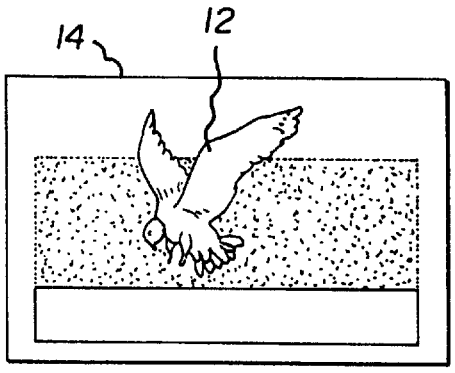
Fig. 2 PRIOR ART
FIG. 2 is a plan view of a sublimation decal of the type employed by the prior art.

FIG. 2 shows a plan view of a sublimation decal 14 with an image 12 to be transferred to the mug 10. Such a decal usually includes a temporary backing sheet, which can be fiberglass cloth, plastic film, paper, thin metal foil, woven or nonwoven fabric, etc., on which the image has been printed with inks including those of the organic base or water-soluble types. Such inks are applied by any of the conventional printing techniques including offset printing, lithographic, thermal dye sublimation, or silk-screening techniques, the image layer having a thickness of from about 0.1 to about 3 mils. In the transfer process pressure is applied to the backing sheet, and the decal and mug are heated to a temperature within the range of from about 200° to 300° Fahrenheit, under a pressure of from about 2 to 30 pounds per inch (PSI). When thus treated, the inks vaporize and condense on the substrate in contact with the decal.

Figure 3:
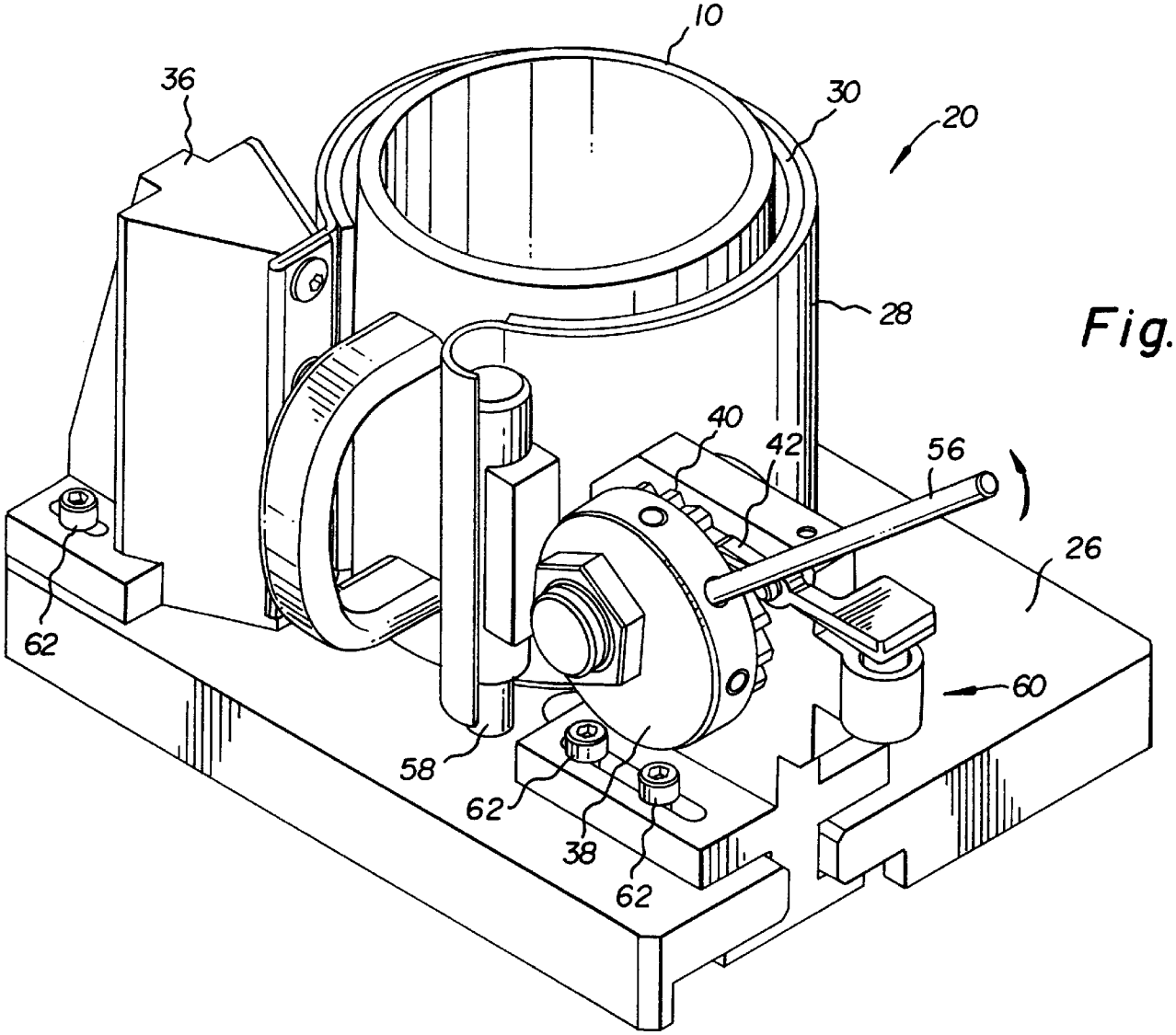
FIG. 3 is an isometric view of a mug printing clamping device according to the present invention in the open position.
Figure 4:
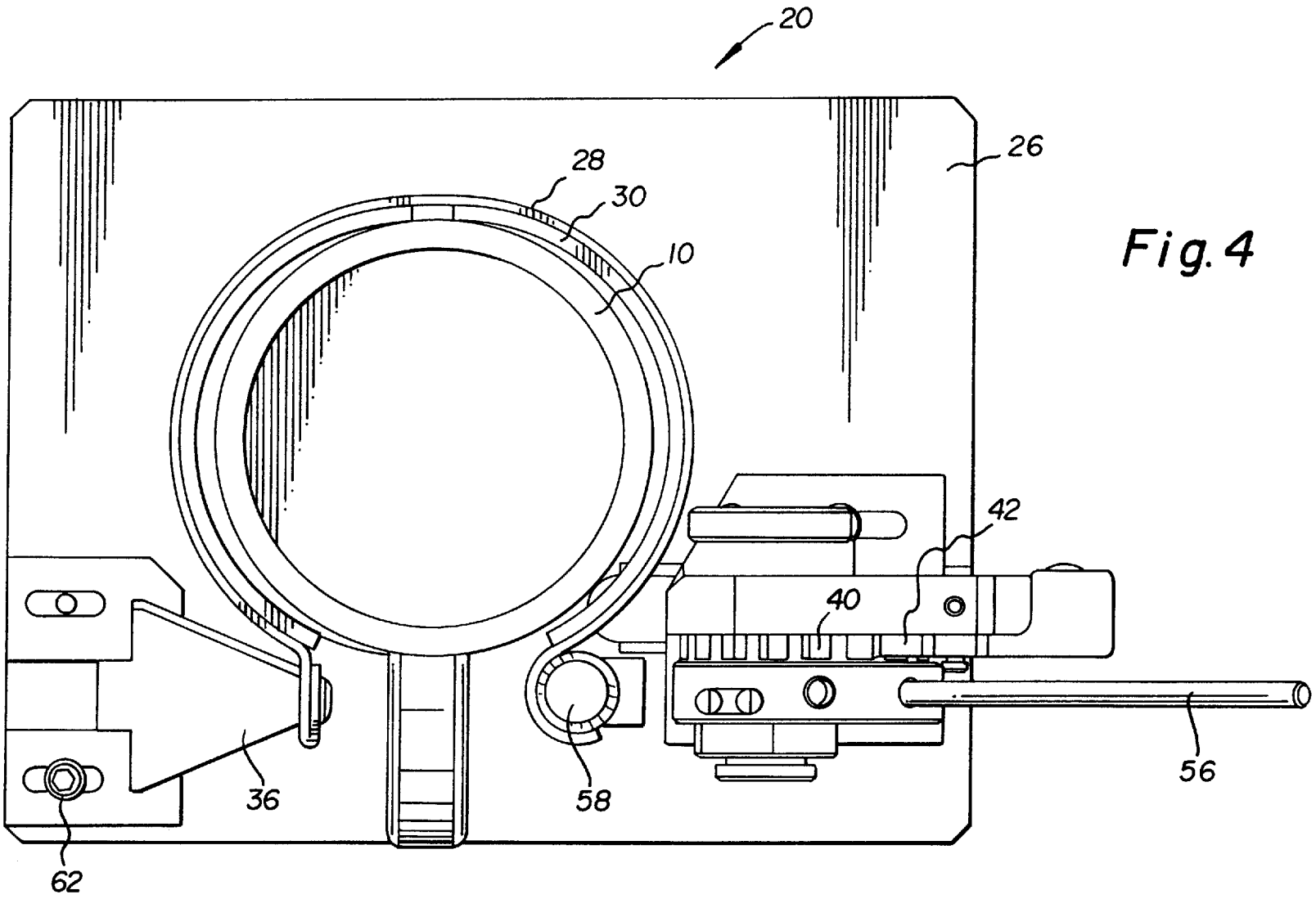
FIG. 4 is a top plan view of the mug printing clamping device shown in FIG. 3.
Figure 5:
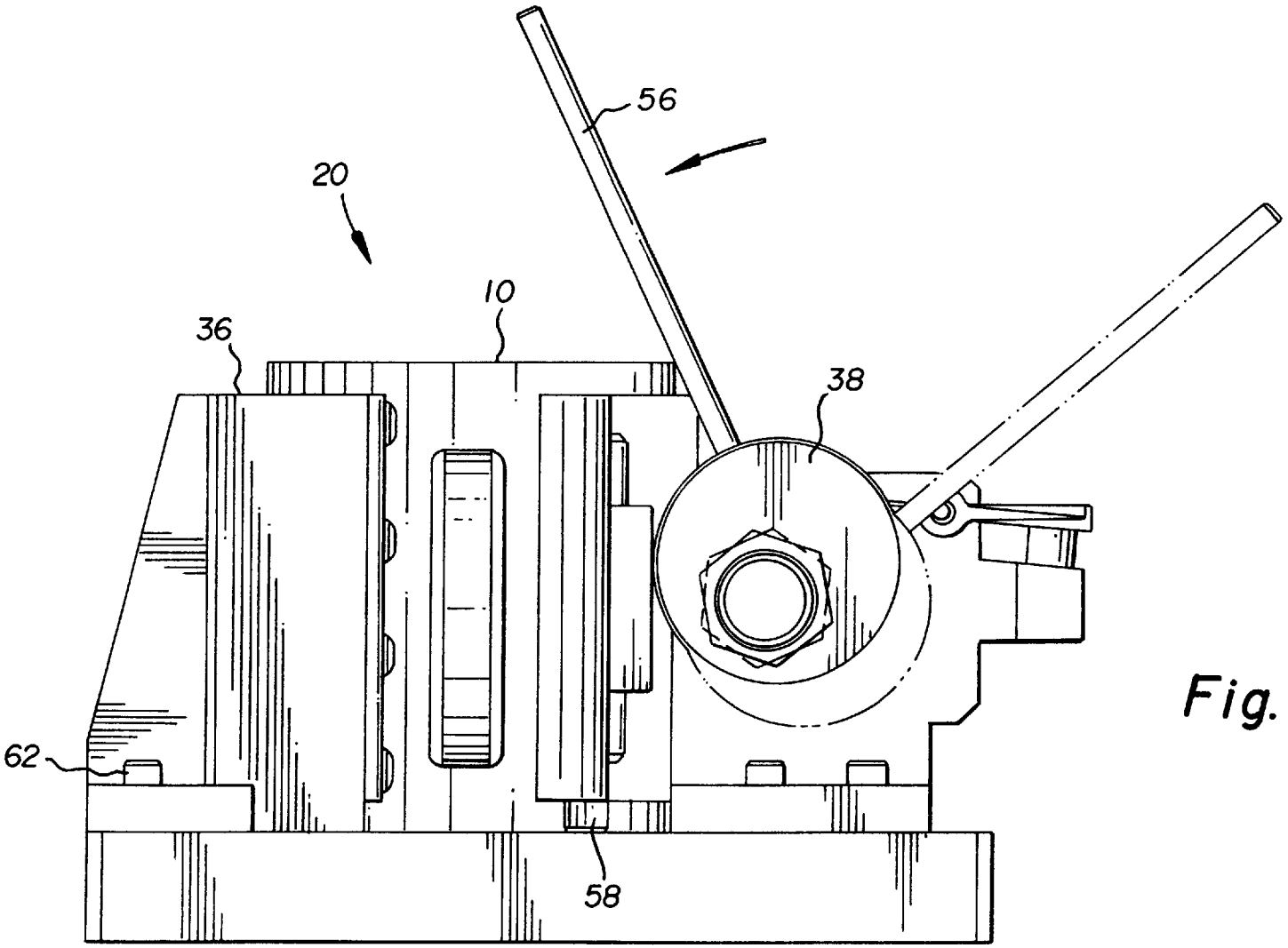
FIG. 5 is a front plan view, partially in phantom, of a mug printing clamping device according to the present invention with the cam rotated to the closed position.
Figure 6:
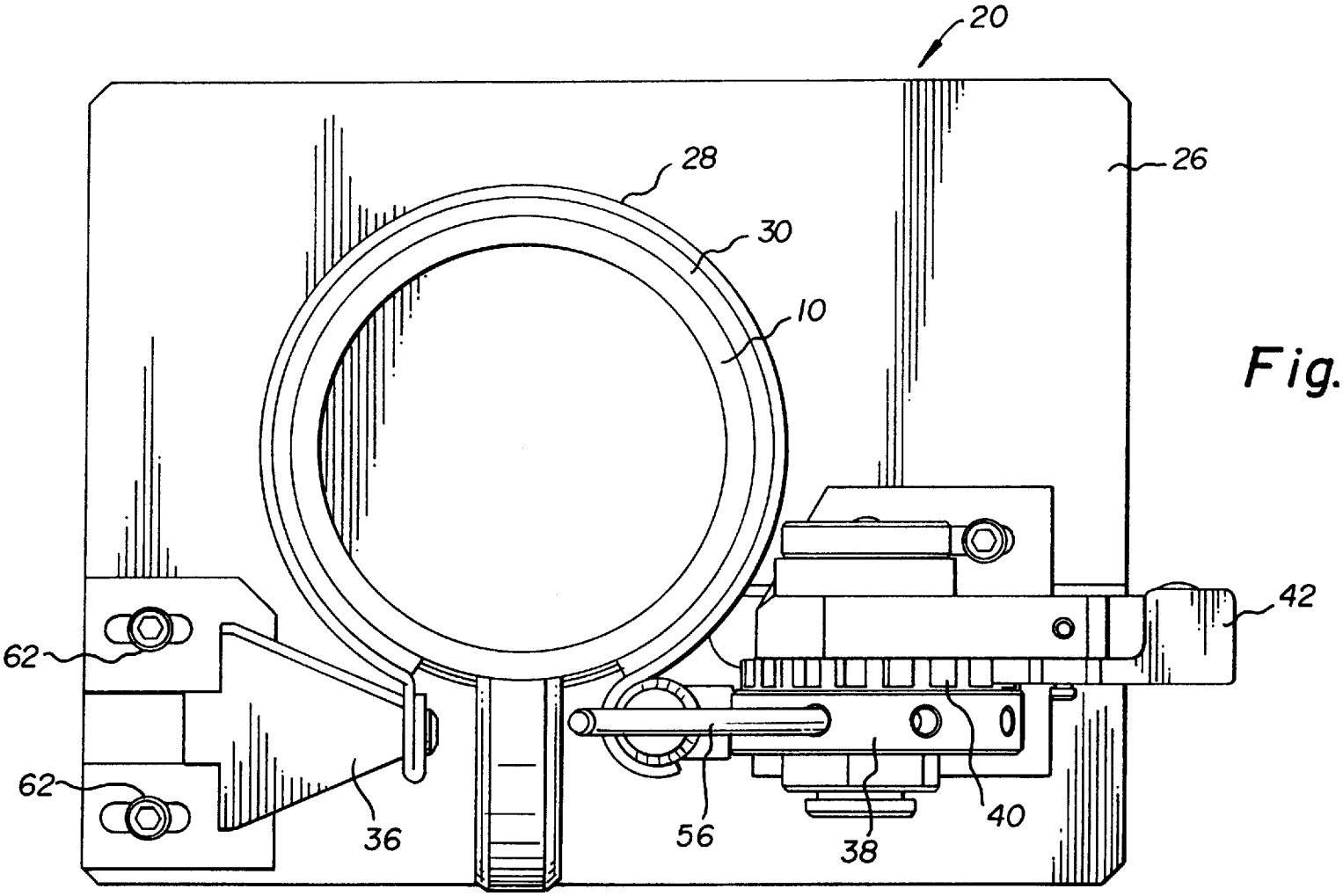
FIG. 6 is a top plan view of the mug printing clamping device shown in FIG. 5.
Figure 7:
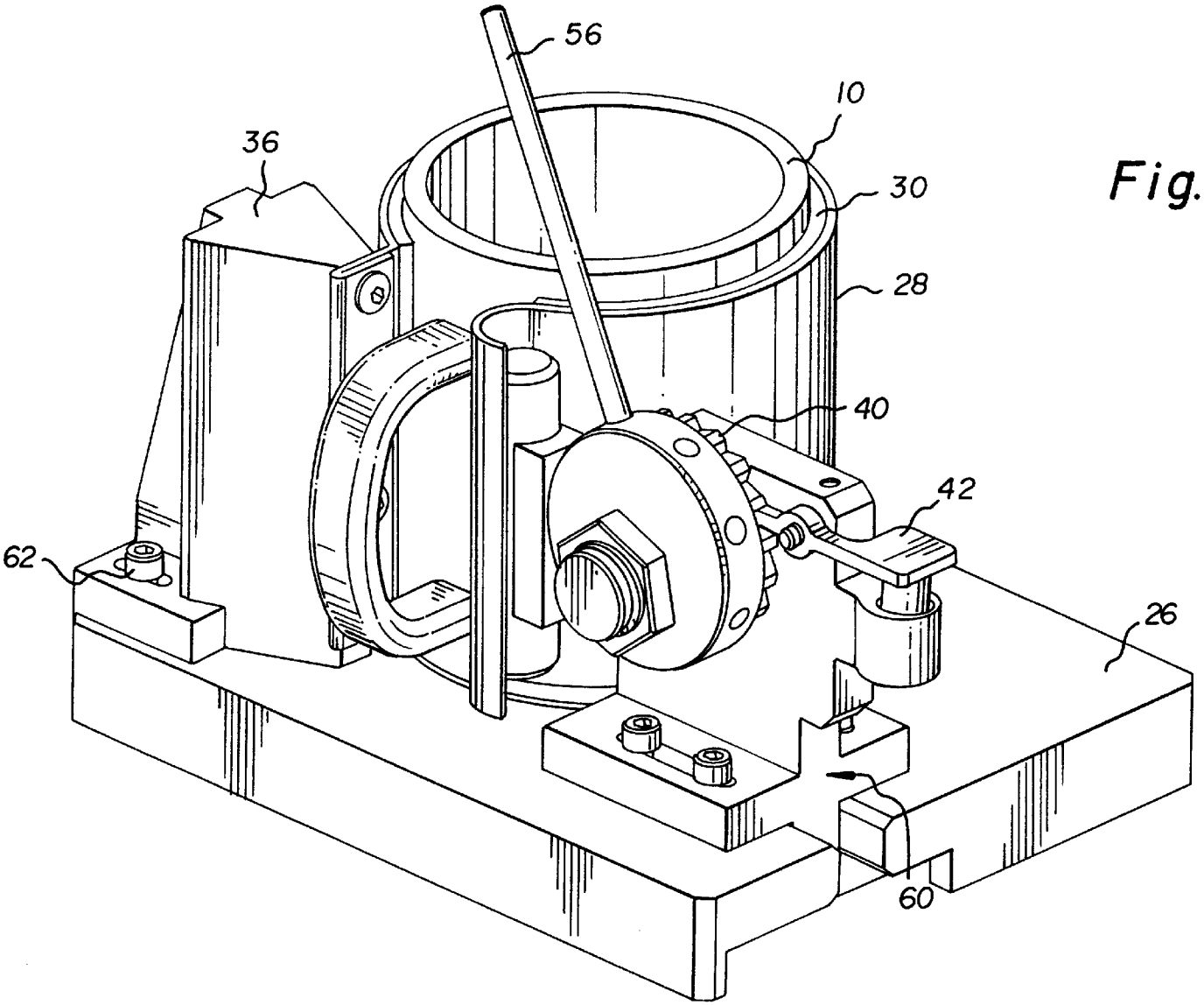
FIG. 7 is an isometric view of a mug printing clamping device according to the present invention in the closed position.

FIGS. 3 and 4 show one embodiment of a mug printing clamping device, in the open position, according to the present invention which is referred to generally by the number 20. As shown, the device comprises a mounting support 26 on which the components of the device, described in more detail below, are mounted.

A flexible band 28 is disposed in a loop configuration forming a cavity into which the mug 10 is inserted. The material comprising the flexible band 28 is not critical, however, it must have sufficient tensile strength to apply proper pressure to the mug and decal and not be subject to brittle fracture due to repeated bending. A suitable material is spring steel although other materials may be substituted.

A flexible pad 30 lines the interior of flexible band 28. The pad 30 may simply be placed adjacent to the flexible band 28, or may be secured to the flexible band 28 by means of a suitable adhesive, such as a silicone adhesive, capable of withstanding elevated temperatures. The pad 30 is normally constructed to be from about 6 to 10 inches in length, which is adequate to produce a loop in flexible band 28 of from about 2 to 3 inches in diameter.

Pad 30 may be electricity heated by wires, not shown, which are embedded in the pad. The spaced electrical resistance heating wires may be connected in series or may be an etched foil encapsulated in a layer of high temperature polymer. Typically, an electric wiring density is provided which will produce temperatures from 200° to 300° Fahrenheit within two to three minutes. Pad 30 materials may be selected from any of the materials commonly used for such purpose including, DuPont's "Kapton" or "Nomex", silicone rubber, and other equivalent materials.

One end of the flexible band 28 is attached to adjustable post 36, which is connected to mounting support 26. The other end of flexible band 28 is connected to slidable post 58. Slidable post is mounted approximately perpendicular to a surface of support 26, and moves in a direction approximately parallel to a line tangent to the circumference of mug 10.

Adjustable post 36 and ratchet assembly 60 are both removably mounted on support 26 to provide a means of adapting the mug printing clamping device 20 to large variations in mug diameter, for example variation of greater than one-half inch change in diameter between mugs. Variations up to one-half inch can be accommodated by mug printing clamping device without adjustment which is suitable for normal variation in lot size and mug styles. Such adjustment, when needed, is made by loosening cap screws 62 and moving slidable post 36, or ratchet assembly 60, or both, to the desired new position.

In operation, shown in FIGS. 3 through 7, mug 10 is placed inside flexible band 28 and pad 30, and a decal 14, is placed between pad 30 and mug 10. Eccentric cam 38 is rotated counter clockwise, which moves slidable post 58 toward adjustable post 36 to tighten flexible band 28 until the loop formed by flexible band 28 is disposed relatively closely about the periphery of the mug 10.

Tension is induced in the flexible band 28 by movement of the tension handle 56 in the direction of the adjacent arrow, which rotates eccentric cam 38 in a counter clockwise direction, resulting in radial pressure being applied to the mug disposed in the loop of flexible band 28. The position of flexible band 28 is maintained by pawl 42, which engages spindle ratchet gear 40, shown more clearly in FIG. 4. Tension handle 56 and eccentric cam 38 are mounted on ratchet assembly 60. Ratchet gear 40 and pawl 42 allows cam 38 to be locked in position in a wide variety of positions allowing mug printing clamping device 20 to accommodate a wide variety of mug sizes with a one step clamping operation. The eccentric cam 38, increase the translational movement of the slidable post 58 at an increasing rate as the eccentric cam is turned counter clockwise, thereby accommodating a greater variety of mug diameters with out a separate adjustment of the adjustable post 36.

Heat is applied to the decal 14 and mug 10 to transfer the image from the decal to the mug. While temperatures and cycle times will naturally depend upon the nature of the sublimation inks making up the design imprinted on the design decal, the transfer process is usually carried out at a temperature of from about 200° to 300° Fahrenheit, for a period of from about 2 to 3 minutes.

The controls and instrumentation of the mug printing clamping device 20 are not shown however they are well known in the art and include: an adjustable temperature controller, which controls the flow of current applied to the heating elements which may be encapsulated in pad 30; a thermocouple, which senses the temperature of the mug 10; a temperature indicator; a protective circuit breaker; and a timer control which sets the timing cycle.

With respect to the mug printing clamping device 20 it will be appreciated that the tension can be varied in accordance with techniques and designs known to those skilled in the art. Similarly, the instruments and controls used to operate the device can also be modified without altering the basic concept of the invention. The term mug has been used in the specifications it will be appreciated by those skilled in the art that the device claimed is suitable for transferring images from decals to any cylindrical object. Also, different means of heating the decal and mug to transfer the image from the decal to the mug will fall within the scope of the invention as defined by the claims.

| PARTS LIST |
|---|
| 10. Mug |
| 12. Image |
| 14. Decal |
| 20. Clamping Device |
| 26. Support |
| 28. Flexible band |
| 30. Heating Pad |
| 36. Adjustable Post |
| 38. Eccentric Cam |
| 40. Ratchet Gear |
| 42. Pawl |
| 56. Handle |
| 58. Slidable Post |
| 60. Ratchet Assembly |
| 62. Cap Screws |

What is claimed is:

1. A mug printing clamping device for transferring an image through the use of heat and pressure from a decal to a mug comprising:

a flexible band adapted for deformation about a curved surface of the mug, and forming an approximately circular cavity;

a means for heating the decal and the mug;

a cam which produces a tension in said flexible band as said cam is rotated, putting pressure in the mug and decal located in said cavity;

a ratchet and pawl which locks said cam into position;

said cam, rachet and pawl allowing said clamping device to accommodate a wide variety of mug sizes.

2. A mug printing clamping device according to claim 1 further comprising a pad which lines an interior surface of said flexible band.

3. A mug printing clamping device according to claim 1 wherein said heating means is a pad lining an interior surface of said cavity, and adapted to produce heat.

4. A mug printing clamping device according to claim 1 wherein said cam is an eccentric cam.

5. A mug printing clamping device according to claim 1 further comprising:

an adjustable post which anchors a first end of said flexible band, wherein said adjustable post is attached to a support;

a slidable post which anchors a second end of said flexible band; and said cam applies tension to said flexible band by slidably moving said slidable post toward said adjustable post.

6. A mug printing clamping device according to claim 5 wherein said adjustable post is attached to said support by a cap screw.

7. A method of transferring an image to a cylindrical object comprising the steps of:

selecting a cylindrical object from a group of cylindrical objects having a wide variety of diameters, inserting said cylindrical object into an interior cavity formed by a flexible band;

inserting a decal containing said image between said cylindrical object and said flexible band;

applying tension to said flexible band by a cam means, wherein said flexible band applies radial pressure on said decal and said cylindrical object;

locking said can in position by a ratchet and pawl; and heating said decal and said cylindrical object.

8. A method of transferring an image to a cylindrical object as in claim 7 wherein a pad lines the interior surface of said flexible band.

9. A method of transferring an image to a cylindrical object as in claim 7 wherein said heating is provided by a pad lining an interior surface of flexible band.

10. A method of transferring an image to a cylindrical object as in claim 7 wherein said cam means is an eccentric cam.

11. A method of transferring an image to a cylindrical object as in claim 7 comprising the additional step of:

wherein said cam means applies said tension to said flexible band by slidably moving a slidable post attached to a first end of said flexible band, toward an adjustable post attached to a second end of said flexible band.

* * * * *